US008376597B2

(12) United States Patent
Nakata et al.

(10) Patent No.: US 8,376,597 B2
(45) Date of Patent: Feb. 19, 2013

(54) VEHICULAR LAMP

(75) Inventors: Junya Nakata, Shizuoka (JP); Asami Nakada, Shizuoka (JP); Yoshiaki Furuya, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 59 days.

(21) Appl. No.: 13/162,971

(22) Filed: Jun. 17, 2011

(65) Prior Publication Data

US 2011/0310630 A1 Dec. 22, 2011

(30) Foreign Application Priority Data

Jun. 18, 2010 (JP) ..... 2010-139033

(51) Int. Cl.
*F21V 8/00* (2006.01)

(52) U.S. Cl. ..... 362/511; 362/545; 362/522

(58) Field of Classification Search ..... 362/511, 362/545, 522

See application file for complete search history.

(56) References Cited

U.S. PATENT DOCUMENTS

| | | | | |
|---|---|---|---|---|
| 7,270,454 | B2 * | 9/2007 | Amano | 362/522 |
| 2006/0034094 | A1 * | 2/2006 | Asada et al. | 362/545 |
| 2008/0013333 | A1 * | 1/2008 | Koizumi et al. | 362/511 |

FOREIGN PATENT DOCUMENTS

JP 2009-295552 A 12/2009

OTHER PUBLICATIONS

English abstract of JP2009-295552 published on Dec. 17, 2009, espacenet Worldwide Database, 1 page.

* cited by examiner

*Primary Examiner* — Tracie Y Green
(74) *Attorney, Agent, or Firm* — Osha Liang LLP

(57) ABSTRACT

A vehicular lamp includes a lamp outer case formed by a cover and a lamp housing; a light source disposed inside the lamp outer case; and a light guide that guides light emitted from the light source, wherein the light guide is shaped as a column. The light guide includes a first extension portion that extends on a horizontal plane side, and a second extension portion that extends on a vertical plane side with respect to a reference line that extends in a direction inclined 45 degrees with respect to the horizontal plane. An outer surface of the light guide includes an incident surface to which light emitted from the light source is incident, an internal reflection surface that internally reflects light incident from the incident surface, and a radiation surface that is formed as an outward-convexly curved surface and radiates at least light reflected by the internal reflection surface. ρ1 is a curvature of the radiation surface in a cross section perpendicular to a direction in which the first extension portion extends, ρ2 is a curvature of the radiation surface in a cross section perpendicular to a direction in which the second extension portion extends, and ρ1 is smaller than ρ2.

4 Claims, 3 Drawing Sheets

VEHICULAR LAMP

BACKGROUND OF INVENTION

1. Field of the Invention

The present invention relates to a vehicular lamp. More specifically, the present invention relates to a technical field of securing a desired light distribution pattern by varying a curvature of a radiation surface of a light guide based on an angle of the curvature with respect to a horizontal plane.

2. Related Art

There are vehicular lamps that include a light source inside a lamp outer case that is formed by a cover and a lamp housing, and a light guide that guides light emitted from the light source in a predetermined direction (see Patent Document 1, for example).

According to the vehicular lamp described in Patent Document 1, a light guide is formed into a ring configuration. Light emitted from a light source is entirely reflected by an inner surface (internal reflection surface) of the light guide, and guided in a predetermined direction so as to radiate from a radiation surface. The cross-sectional shape of the light guide in an extending direction thereof is formed generally circular.

[Patent Document 1] Japanese Patent Application Laid-Open (Kokai) No. 2009-295552

SUMMARY OF INVENTION

With respect to light emitted from a light source in a vehicular lamp and irradiated outward, a desired light distribution pattern must be secured based on the shape of the light guide, the application of the vehicular lamp, and so forth. For example, it is necessary to form an elliptical light distribution pattern that is horizontally oblong for a vehicular marker lamp such as a clearance lamp or a tail lamp.

However, the vehicular lamp described in Patent Document 1 does not perform a light distribution control based on the positions and shapes of various parts of the light guide, and a light distribution pattern based on the shape of the light guide, the application of the vehicular lamp, and so forth, is not secured.

A vehicular lamp according to one or more embodiments of the present invention may easily secure a desired light distribution pattern.

In one or more embodiments of the present invention, a vehicular lamp includes, inside a lamp outer case that is formed by a cover and a lamp housing, a light source and a light guide that guides light emitted from the light source in a predetermined direction. The light guide is shaped as a column that extends in a predetermined direction, and includes a first extension portion that extends on a horizontal plane side and a second extension portion that extends on a vertical plane side with respect to a reference line that extends in a direction inclined 45 degrees with respect to the horizontal plane. An outer surface of the light guide includes an incident surface to which light emitted from the light source is incident, an internal reflection surface that internally reflects light incident from the incident surface, and a radiation surface that is formed as an outward-convexly curved surface and radiates at least light reflected by the internal reflection surface. $\rho 1$ is a curvature of the radiation surface in a cross section perpendicular to a direction in which the first extension portion extends, and $\rho 2$ is a curvature of the radiation surface in a cross section perpendicular to a direction in which the second extension portion extends, wherein $\rho 1$ is smaller than $\rho 2$.

Thus, in the vehicular lamp, light radiated from the light guide can be condensed or diffused based on the curvature of the radiation surface.

A vehicular lamp according to one or more embodiments of the present invention includes, inside a lamp outer case that is formed by a cover and a lamp housing, a light source and a light guide that guides light emitted from the light source in a predetermined direction. The vehicular lamp is characterized in that the light guide is shaped as a column that extends in a predetermined direction, and includes a first extension portion that extends on a horizontal plane side and a second extension portion that extends on a vertical plane side with respect to a reference line that extends in a direction inclined 45 degrees with respect to the horizontal plane. In addition, an outer surface of the light guide includes an incident surface to which light emitted from the light source is incident, an internal reflection surface that internally reflects light incident from the incident surface, and a radiation surface that is formed as an outward-convexly curved surface and radiates at least light reflected by the internal reflection surface. Further, $\rho 1$ is a curvature of the radiation surface in a cross section perpendicular to a direction in which the first extension portion extends, and $\rho 2$ is a curvature of the radiation surface in a cross section perpendicular to a direction in which the second extension portion extends, wherein $\rho 1$ is smaller than $\rho 2$.

Thus, light with differing degrees of concentration and diffusion is radiated based on the positions and shapes of various parts of the light guide, and a desired light distribution pattern can be easily secured based on the shape of the light guide, the application of the vehicular lamp, and so forth.

According to one or more embodiments of the present invention, the light guide is provided with a plurality of lens steps formed continuous at positions opposite the radiation surface, with an axis in a direction in which the light guide extends located between the radiation surface and the plurality of lens steps, and each surface that forms the lens steps is the internal reflection surface.

Thus, regardless of the shape of the light guide, light can be radiated from the radiation surface in a required direction.

According to one or more embodiments of the present invention, the first extension portion is formed so as to displace rearward as the first extension portion extends upward, and the second extension portion is formed so as to displace rearward as the second extension portion extends toward an outer side in a vehicle width direction.

Thus, the light guide can be disposed along the outer shape of the cover, which increases design flexibility in terms of layout and also achieves a more compact vehicular lamp through the effective use of layout space.

Other aspects and advantages of the invention will be apparent from the following description, the drawings and the claims.

DETAILED DESCRIPTION

Hereinafter, a vehicular lamp according to embodiments of the present invention will be described with reference to the accompanying drawings. In the description of the various embodiments, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

A vehicular lamp 1 is disposed in both right and left end portions of a front end portion or a rear end portion of a vehicle body. The vehicular lamp 1 may be used, for example, as a so-called clearance lamp that functions as a width indicator lamp, a so-called daytime running lamp that is lit during times other than nighttime, a so-called tail lamp that functions as a marker lamp for a following vehicle or the like, or a lamp that has a combination of these functions.

Figure 1:
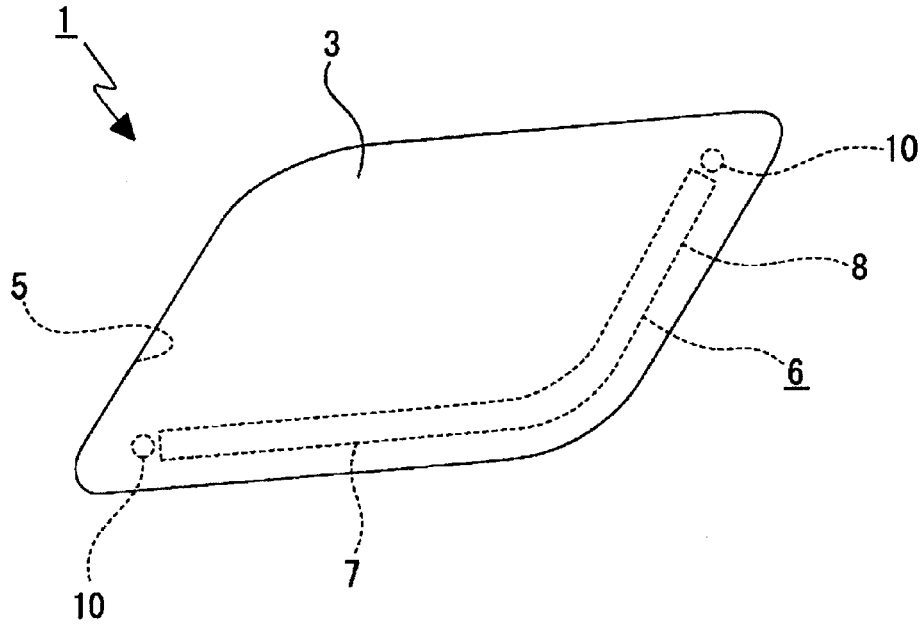
FIG. 1 shows a vehicular lamp according to one or more embodiments of the present invention, and is a schematic frontal view of the vehicular lamp.
Figure 2:
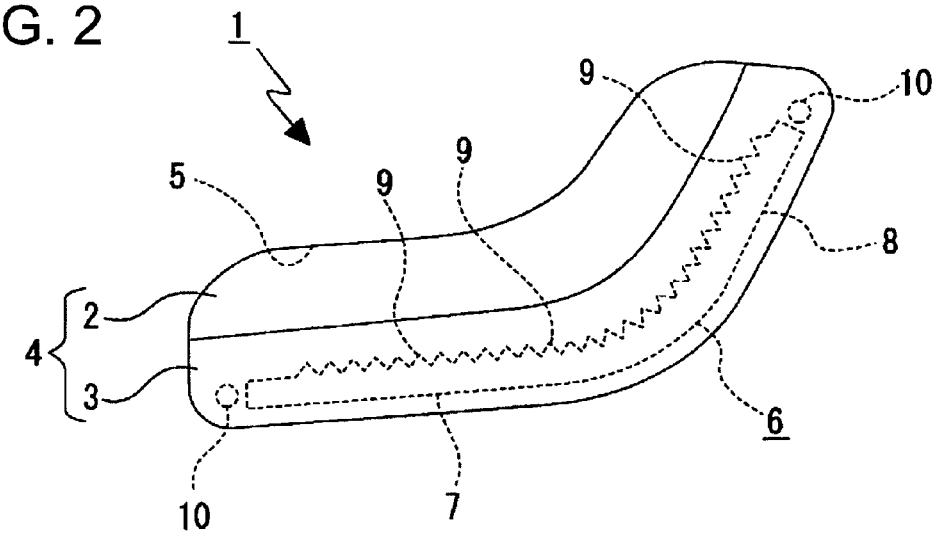
FIG. 2 is a schematic plane view of the vehicular lamp.

The vehicular lamp 1, as FIGS. 1 and 2 show, includes a lamp housing 2 that has a concave portion opening in one direction, and a cover 3 that closes the opening face of the lamp housing 2. The lamp housing 2 and the cover 3 configure a lamp outer case 4. An internal space of the lamp outer case 4 is formed as a lamp chamber 5.

The cover 3 is arranged so as to be longitudinally inclined with respect to a lateral direction, and an outer surface of the cover 3 is formed as a curved surface that gently curves outward in a convex manner (see FIG. 2).

A light guide 6 that extends along the cover 3 is disposed in the lamp chamber 5 (see FIGS. 1 and 2). Both end surfaces of the light guide 6 in an extending direction thereof are formed as incident surfaces 6*a*, 6*a*, respectively.

The light guide 6 is shaped as a column, and formed from a first extension portion 7 and a second extension portion 8 that are continuous from one another.

Figure 3:
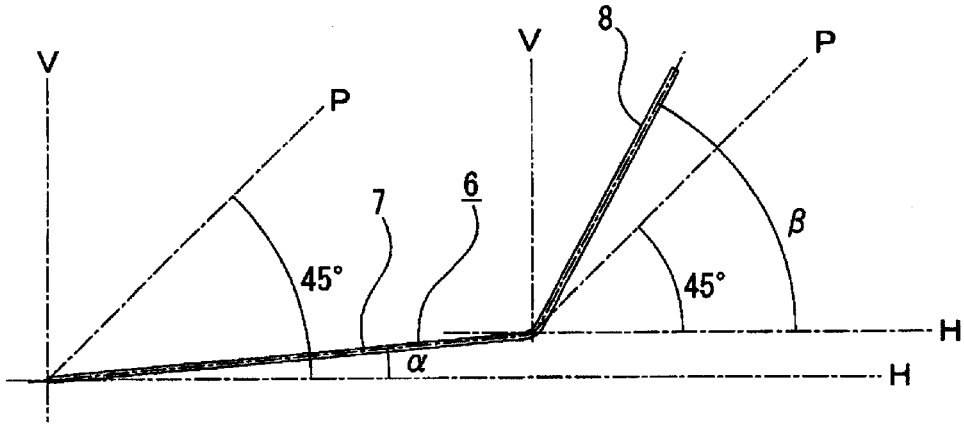
FIG. 3 is a conceptual diagram for explaining a shape of a light guide.

In the vehicular lamp 1, as FIG. 3 shows, if a line that extends in a direction inclined 45 degrees with respect to a horizontal plane H is designated as a reference line P, the first extension portion 7 extends on a horizontal plane H side with respect to the reference line P and the second extension portion 8 extends on a vertical plane V side with respect to the reference line P. Accordingly, an inclination angle $\alpha$ of the first extension portion 7 with respect to the horizontal plane H is smaller than 45 degrees, and an inclination angle $\beta$ of the second extension portion 8 with respect to the horizontal plane H is larger than 45 degrees.

In addition, in the light guide 6, the first extension portion 7 is formed so as to displace rearward as the first extension portion 7 extends upward, and the second extension portion 8 is formed so as to displace rearward as the second extension portion 8 extends toward an outer side in a vehicle width direction (see FIG. 2).

Figure 4:
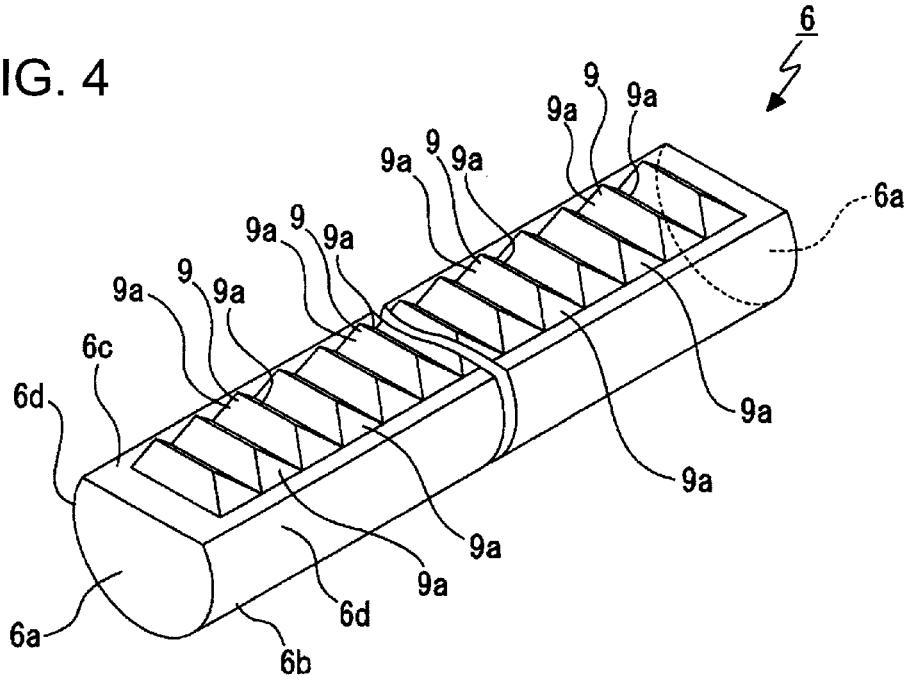
FIG. 4 is a perspective view that shows a portion of the light guide.

As FIG. 4 shows, the following are formed as outer peripheral surfaces of the light guide 6: a surface on a side facing the cover 3 is formed as a convexly curved radiation surface 6*b* on the cover 3 side of the light guide 6; a surface on a side opposite the radiation surface 6*b* is formed as a flat step formation surface 6*c*; and surfaces between the radiation surface 6*b* and the step formation surface 6*c* are formed as continuous surfaces 6*d*, 6*d*, respectively.

Figure 5:
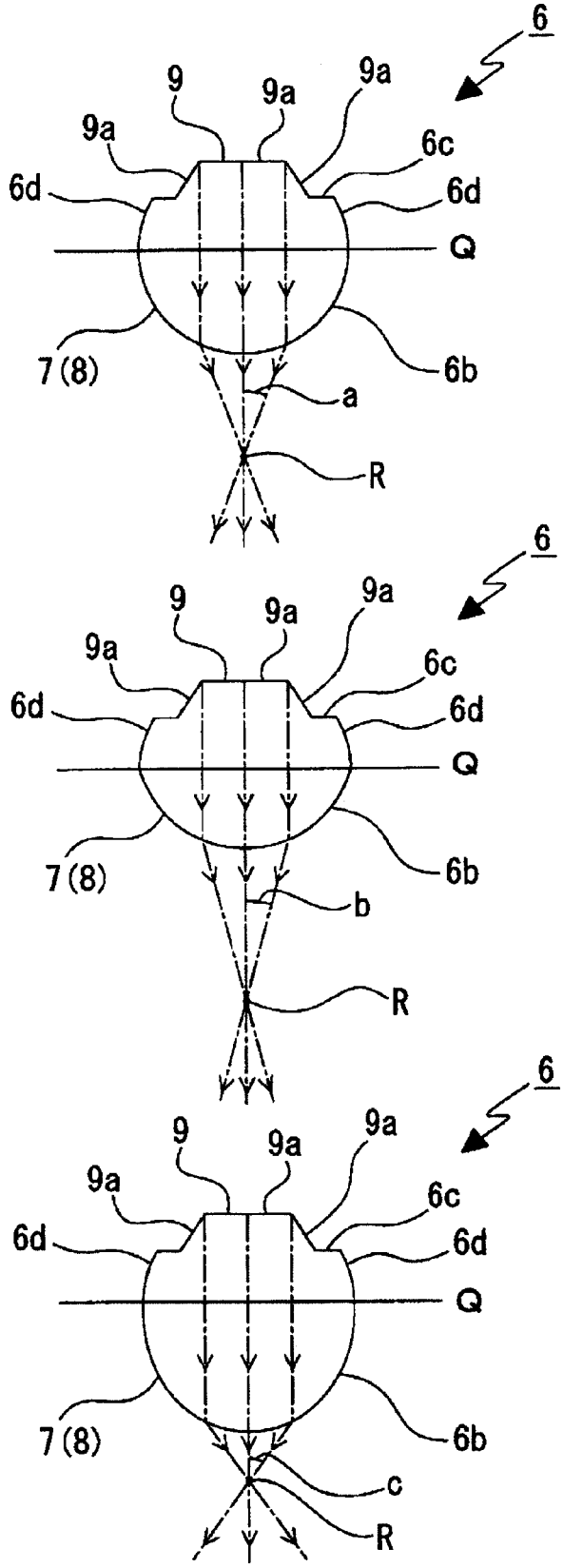
FIG. 5 shows schematic diagrams of light radiation states according to variations in a curvature of a radiation surface of the light guide, wherein the top diagram shows a semicircular radiation surface, the middle diagram shows a radiation surface whose curvature is smaller than a semicircle, and the bottom diagram shows a radiation surface whose curvature is larger than a semicircle.

The radiation surface 6*b* of the light guide 6, as FIG. 5 shows, is positioned more toward the cover 3 side than a line segment Q parallel to the step formation surface 6*c*, and, using a semicircle as a reference (see the top diagram in FIG. 5), has different curvatures in the first extension portion 7 and the second extension portion 8. In other words, a curvature $\rho 1$ of the radiation surface 6*b* in the first extension portion 7 (see the middle diagram in FIG. 5) is smaller than a curvature $\rho 2$ of the radiation surface 6*b* in the second extension portion 8 (see the bottom diagram in FIG. 5). For example, the curvature $\rho 1$ of the radiation surface 6*b* in the first extension portion 7 has a smaller curvature than the curvature of the semicircle state, and the curvature $\rho 2$ of the radiation surface 6*b* in the second extension portion 8 has a larger curvature than the curvature of the semicircle state.

Accordingly, an incident angle b of the first extension portion 7 with respect to a focal point R is smaller than an incident angle a of the semicircle state with respect to the focal point R, and an incident angle c of the second extension portion 8 with respect to the focal point R is larger than the incident angle a of the semicircle state with respect to the focal point R. Thus, light radiated from the radiation surface 6*b* in the first extension portion 7 becomes condensed light, and light radiated from the radiation surface 6*b* in the second extension portion 8 becomes diffused light.

The step formation surface 6*c* of the light guide 6 is formed with a plurality of lens steps 9, 9, . . . (see FIG. 4). The lens steps 9, 9, . . . are formed continuous opposite the radiation surface 6*b*, with an axis in the direction in which the light guide 6 extends located between the lens steps 9, 9, . . . and the radiation surface 6*b*.

The lens steps 9, 9, . . . each have a cross section that is formed triangular, for example, and the surfaces forming the lens steps 9, 9, . . . are formed as internal reflection surfaces 9*a*, 9*a*, . . . , respectively.

Light sources 10, 10 are respectively disposed at positions near the incident surfaces 6*a*, 6*a* of the light guide 6 (see FIGS. 1 and 2). Light emitting diodes are used as the light sources 10, 10, for example.

A reflector, not shown, is disposed in the lamp chamber 5 so as to follow the light guide 6. A reflection surface of the reflector is positioned facing the step formation surface 6*c*.

In the vehicular lamp 1 thus configured, when light is emitted from each of the light sources 10, 10, the emitted light is incident to the light guide 6 from the incident surfaces 6*a*, 6*a*. Such light is guided in the direction in which the light guide 6 extends while being repeatedly and entirely reflected by the internal reflection surfaces 9*a*, 9*a*, . . . of the lens steps 9, 9, . . . , or radiated from the radiation surface 6*b*.

Among the light from the light sources 10, 10 incident via the incident surfaces 6*a*, 6*a*, there is also light that passes through the lens steps 9, 9, . . . or the step formation surface 6*c*. The light that passes through the lens steps 9, 9, . . . or the step formation surface 6*c* is reflected by the reflection surface of the reflector and again incident to the light guide 6, after which such light is guided in the direction in which the light guide 6 extends, or radiated from the radiation surface 6*b*.

At such time, light radiated from the radiation surface 6*b* in the first extension portion 7 whose inclination angle with respect to the horizontal plane H is smaller than 45 degrees becomes condensed light because the curvature $\rho 1$ of the radiation surface 6*b* is small, and such light is irradiated outward. Meanwhile, light radiated from the radiation surface 6*b* in the second extension portion 8 whose inclination angle with respect to the horizontal plane H is larger than 45 degrees becomes diffused light because the curvature $\rho 2$ of the radiation surface 6*b* is large, and such light is irradiated outward.

As described above, in the vehicular lamp 1, the curvature ρ1 of the radiation surface 6*b* in the first extension portion 7 is smaller than the curvature ρ2 of the radiation surface 6*b* in the second extension portion 8. Therefore, condensed light and diffused light are radiated based on the positions and shapes of various parts of the light guide 6, and a desired light distribution pattern can be easily secured based on the shape of the light guide 6, the application of the vehicular lamp 1, and so forth.

In addition, the light guide 6 is provided with the plurality of lens steps 9, 9, . . . formed continuous at positions opposite the radiation surface 6*b*, with the axis in the direction in which the light guide 6 extends located between the plurality of lens steps 9, 9, . . . and the radiation surface 6*b*. Accordingly, regardless of the shape of the light guide 6, for example, even if the light guide 6 has a twisted shape, light can be radiated from the radiation surface 6*b* in a required direction.

Further, in the light guide 6, the first extension portion 7 is formed so as to displace rearward as the first extension portion 7 extends upward, and the second extension portion 8 is formed so as to displace rearward as the second extension portion 8 extends toward an outer side in the vehicle width direction. Accordingly, the light guide 6 can be disposed along the outer shape of the cover 3, which increases design flexibility in terms of layout and also achieves a more compact vehicular lamp 1 through the effective use of layout space.

Note that the above description relates to embodiments in which both end surfaces of the light guide 6, in the direction in which the light guide 6 extends, are used as the incident surfaces 6*a*, 6*a*, and the light of the light sources 10, 10 is made incident to the light guide 6 from the respective incident surfaces 6*a*, 6*a*. However, in one or more embodiments with another possible configuration, only one end surface of the light guide 6 in the direction in which the light guide 6 extends may be used as the incident surface 6*a*, and the light of one light source 10 may be made incident to the light guide 6 from the incident surface 6*a*.

In order to increase the radiation efficiency of light from the light guide 6 in such cases, when an end surface of the light guide 6 on an inner side in the vehicle width direction is used as the incident surface 6*a*, in one or more embodiments, the cross-sectional shape of the lens step is trapezoidal, and, when an end surface of the light guide 6 on an outer side in the vehicle width direction is used as the incident surface 6*a*, in one or more embodiments, the cross-sectional shape of the lens step is triangular.

The shapes and structures of the respective portions described above are merely examples for carrying out embodiments of the present invention. While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

| [Description of the Reference Numerals] | |
|---|---|
| 1 | VEHICULAR LAMP |
| 2 | LAMP HOUSING |
| 3 | COVER |

-continued

| [Description of the Reference Numerals] | |
|---|---|
| 4 | LAMP OUTER CASE |
| 6 | LIGHT GUIDE |
| 6a | INCIDENT SURFACE |
| 6b | RADIATION SURFACE |
| 7 | FIRST EXTENSION PORTION |
| 8 | SECOND EXTENSION PORTION |
| 9 | LENS STEP |
| 9a | INTERNAL REFLECTION SURFACE |
| 10 | LIGHT SOURCE |

What is claimed is:

1. A vehicular lamp comprising:

a lamp outer case formed by a cover and a lamp housing;

a light source disposed inside the lamp outer case; and a light guide that guides light emitted from the light source, wherein the light guide is shaped as a column, wherein the light guide comprises:

a first extension portion that extends on a horizontal plane side, and a second extension portion that extends on a vertical plane side with respect to a reference line that extends in a direction inclined 45 degrees with respect to the horizontal plane, wherein an outer surface of the light guide comprises:

an incident surface to which light emitted from the light source is incident, an internal reflection surface that internally reflects light incident from the incident surface, and a radiation surface that is formed as an outward-convexly curved surface and radiates at least light reflected by the internal reflection surface, and wherein ρ1 is a curvature of the radiation surface in a cross section perpendicular to a direction in which the first extension portion extends, wherein ρ2 is a curvature of the radiation surface in a cross section perpendicular to a direction in which the second extension portion extends, and wherein ρ1 is smaller than ρ2.

2. The vehicular lamp according to claim 1, wherein the light guide is provided with a plurality of lens steps formed continuous at positions opposite the radiation surface, with an axis in a direction in which the light guide extends located between the radiation surface and the plurality of lens steps, and wherein each surface that forms the lens steps is the internal reflection surface.

3. The vehicular lamp according to claim 1, wherein the first extension portion is formed so as to displace rearward as the first extension portion extends upward, and wherein the second extension portion is formed so as to displace rearward as the second extension portion extends toward an outer side in a vehicle width direction.

4. The vehicular lamp according to claim 2, wherein the first extension portion is formed so as to displace rearward as the first extension portion extends upward, and wherein the second extension portion is formed so as to displace rearward as the second extension portion extends toward an outer side in a vehicle width direction.

* * * * *